United States Patent [19]

Scola

[11] 4,307,502

[45] Dec. 29, 1981

[54] COMPOSITE RING AND METHOD OF CONSTRUCTING THE SAME

[76] Inventor: Vito A. Scola, 139 Baker St., Providence, R.I. 02905

[21] Appl. No.: 188,767

[22] Filed: Sep. 22, 1980

[51] Int. Cl.[3] ..... A44C 9/00; B23P 13/00

[52] U.S. Cl. ..... 29/160.6; 63/154

[58] Field of Search ..... 63/15, 15.1, 15.2, 15.3, 63/15.4; 29/8, 160.6

[56] References Cited

U.S. PATENT DOCUMENTS

| | | | |
|---|---|---|---|
| 473,139 | 4/1892 | Bernhardt | 29/8 |
| 2,086,493 | 7/1937 | Ellingwood | 63/3 |
| 2,117,176 | 5/1938 | Keehnel et al. | 63/15.4 |
| 2,308,915 | 1/1943 | Haimes et al. | 63/15.4 |
| 2,395,492 | 2/1946 | Meyer | 29/160.6 |
| 2,747,259 | 5/1956 | Brioux | 29/160.6 |

FOREIGN PATENT DOCUMENTS

| | | | |
|---|---|---|---|
| 1912690 | 6/1970 | Fed. Rep. of Germany | 63/15.4 |
| 287534 | 4/1931 | Italy | 29/160.6 |
| 25367 | 2/1908 | Sweden | 29/8 |

*Primary Examiner*—F. Barry Shay

*Attorney, Agent, or Firm*—Salter & Michaelson

[57] ABSTRACT

A composite ring construction in which a relatively wide first circular ring is provided with both an internal groove and an open slot for interengaging receipt of a second ring of substantially lesser width. Normally, the second ring includes ornamentation such as a gem stone or simulation thereof held by a plurality of prongs which also function as the means by which the second ring is held from relative rotational movement with respect to the first ring. The sequential manner of forming the groove, the slot, and a pair of detents in the first ring which in turn are adapted to cooperatively function with the aforesaid holding means is further disclosed.

1 Claim, 9 Drawing Figures

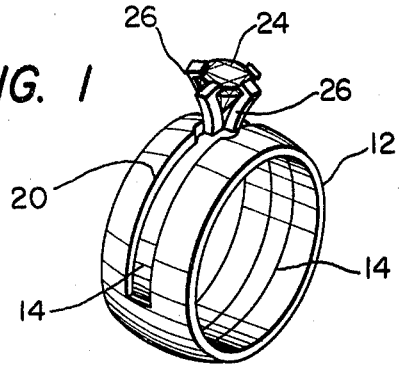
FIG. 1
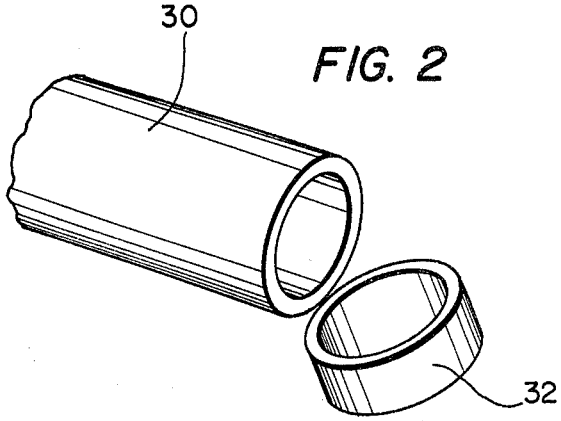
FIG. 2
FIG. 4
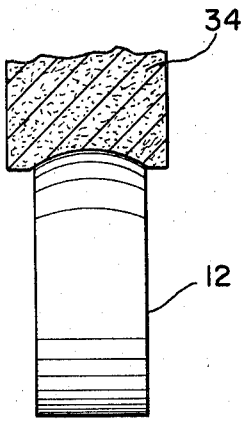
FIG. 3
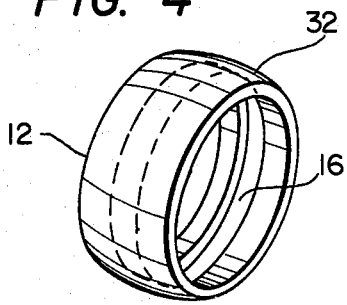
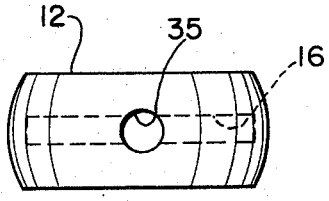
FIG. 5
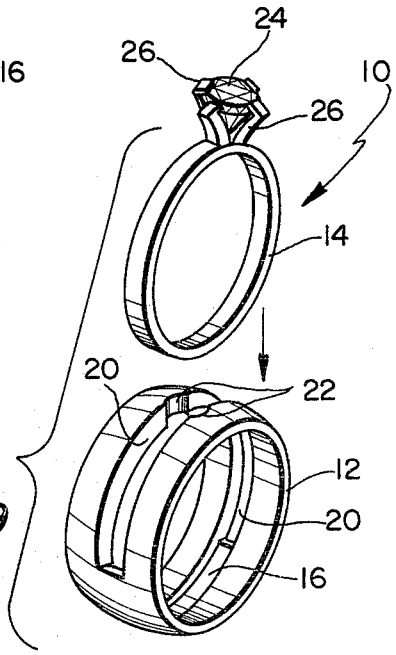
FIG. 9
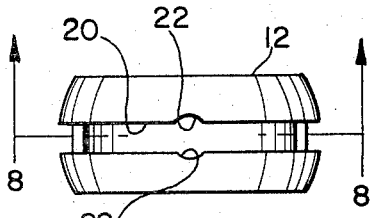
FIG. 6
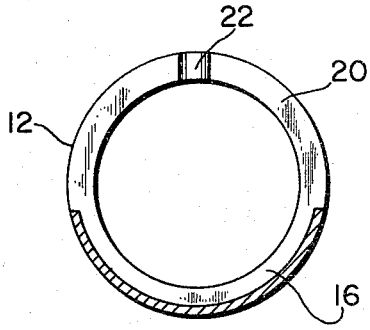
FIG. 8
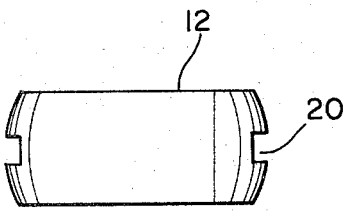
FIG. 7

COMPOSITE RING AND METHOD OF CONSTRUCTING THE SAME

BACKGROUND AND SUMMARY OF THE INVENTION

This invention relates to a composite ring construction and particularly to finger rings of the type that may be worn as a coordinated set. Generally, rings of this type and particularly wedding and engagement rings are sold and purchased separately such that when worn together they may not always create the desired visual effect. Furthermore even when separate engagement and wedding rings are designed to be worn together and worn as a unit, they do not interrelate in such a manner so as to function and give the desirable visual effect of a single ring.

It is accordingly a primary object of the present invention to provide a ring construction which includes separate rings which interrelate to form a composite finger ring construction so as to create the above desired visual effect while further functionally interrelating as a single ring construction.

A still further object of the present invention, is the formation of a finger ring construction of the above identified type and in which one of the separate rings of the composite ring assembly may function as an engagement ring including an ornamental stone, and the other of such rings functions as a wedding band.

A still further object of the present invention, is the provision of a novel method by which one of the rings is formed in such a configuration so as to accept the other ring in a functional and visually pleasing arrangement.

These and other objects of the present invention are accomplished by a composite finger ring construction comprising a relatively wide first circular ring and a second relatively narrow circular ring adapted for removable engagement with said first ring, said first ring having an annular groove in the inner surface thereof communicating with an open slot of at least 180° extent, said groove and said slot being coplanar and each of a width greater than that of said second ring such that said second ring is adapted for insertion through said slot for positioning into said groove whereby said rings are positioned generally coaxially with respect to each other with said second ring positioned within said groove and slot. The construction of the aforementioned first ring further includes a pair of opposed detents generally centrally disposed with respect to said slot, said ring preferrably being formed by the sequential steps of cutting a circular groove around the internal surface of said first ring, boring a circular hole of a diameter slightly greater than the width of said groove through the outer surface of said first ring and thereafter cutting an open slot through said groove and extending around at least one half of the diameter of said first ring, with said hole located at the approximate center of said slot, said hole definning the aforesaid opposed detents.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

FIG. 1 is a perspective view showing the composite ring construction of the present invention in assembled form, that is, with both the first and second rings in interlocking engagement with each other.

FIG. 2 is a perspective view showing an initial step in the formation of the first and wider ring of the composite construction shown in FIG. 1;

FIG. 3 is a somewhat stylistic view showing a second step in the formation of the first ring;

FIG. 4 is a perspective view of the partially completed first ring and further showing the formation of an internal circular groove therein;

FIG. 5 is a top view of the first ring after a further procedural step wherein a hole has been bored through the outside of the ring;

FIG. 6 is a top view of the first ring similar to FIG. 5 but showing an additional procedural step in the formation of the finished construction of the first ring wherein an open slot coaxial with the internal groove has been formed therein;

FIG. 7 is a bottom view showing the construction of the first ring in completed form;

FIG. 8 is a sectional view taken along the line 8–8 of FIG. 6; and

FIG. 9 is a perspective view of the composite ring construction similar to FIG. 1 but showing the first and second rings in exploded relationship to each other.

DESCRIPTION OF THE INVENTION

Referring now to the drawing and more particularly FIGS. 1 and 9 thereof, the overall construction of the composite ring 10 of the present invention is best shown. Therein, a first circular finger ring 12 of relatively extensive width is shaped so as to receive a second ring 14 of relatively lesser width in the desired interlocking relationship so as to form the composite ring construction 10 in the intended manner.

The first ring 12 is particularly adapted to simulate a wedding band, that is, preferably, although not necessarily, constructed from a metal such as brass so as to simulate gold. Alternatively, either or both of the shank portions of the two rings 12 and 14 may be made from precious metals such as gold and silver or may be provided with an electroplated coating thereof. The first ring 12 is additionally provided with an annular internal groove 16 formed in the lower portion thereof and preferably disposed centrally of the longitudinal extent of the ring, that is, intermediate the width thereof. The groove 16, as best shown in FIG. 8, does not extend all the way through the thickness of the ring 12 and as may be best seen from FIG. 1, is adapted to receive the shank 18 of the second ring 14 such that the two rings form a generally continuous, that is, flush internal surface. Accordingly, while the internal diameter of both rings is generally the same, the outside diameter of the first ring 12 is somewhat greater than that of the second ring 14, the difference in outer diameter being generally equal to the remaining thickness of the ring 12 where the groove 16 exists. The ring 16 further is provided with a top open slot 20 of at least a 180° extent, i.e., extending at least half-way around the ring 12. The slot is coaxial with the groove 16 and of a width equal to or slightly larger than that of the shank of the second ring 14 such that the second ring may be readily inserted therein. The slot 20 thus provides the access by which the second ring 14 may be disposed within the first ring 12. In this regard, the shoulders or side walls defining both the groove 16 and the slot 20 prevent longitudinal movement of the second ring with respect to the first ring.

In addition, means are provided in the composite ring structure 10 such that the second ring 14 will not rotationally move with respect to the first ring 12. In this regard a pair of detents 22 which are opposed to each other and which communicate with the slot 20 are provided therein at a point at the upper portion of the first ring 12 intermediate the extent of the slot 20. The second ring 14 is also normally provided with an ornamental stone 24 held to the shank thereof by a setting including a plurality of prongs 26. Two of such prongs are adapted to extend in opposed directions, that is, outwardly of slot 20 so that when the second ring 14 is assembled with the first ring 12, such opposed prongs 26 extend into the detents 22 and hence prevent second ring 14 from rotating with respect to the first ring 12. In this regard it should be pointed out that the oppositely extending detents 26 preferably extend upwardly and outwardly in an angular relationship so as to prevent the second ring 14 from fully extending into the groove 16 in any position except when the opposed prongs 26 are aligned with the detents 22. This insures that the correct functional relationship of the rings with respect to each other is achieved and that the rings do not move relative to each other in their fully assembled position.

The aforementioned construction accordingly accomplishes one of the principal objects of the present invention, that of providing a composite ring construction wherein a first ring such as an engagement ring may be separately worn and thereafter worn in conjunction with the second ring in such a manner that they function both mechanically and esthetically as a composite engagement and wedding ring construction in the intended manner, the ring 12 also functioning as a guard for the ring 14.

Turning now to FIGS. 2 through 6, the novel manner in which the aforementioned structure of the first ring may be realized will now be brought out. In FIG. 2, a cylindrical stock member 30 is shown. As a first step in forming the first ring 12, a segment 32 of the desired overall width of the ring is cut from the member 30. Thereafter, as shown in FIG. 3, the outside surface of the segment 32 is ground to an arcuate shape as is normally desired in rings of this type as by a grinding member 34. Thereafter, the internal surface of the segment 32 is machined to form the internal groove 16 which at this stage is of circular configuration, i.e., extends completely around the segment 32. The groove is preferably disposed centrally of the longitudinal extent or width of the segment 32. Thereafter, as best shown in FIG. 5, a hole is bored by any conventional means through the upper surface of the member 32 and entirely through the thickness thereof such that the hole 35 extends into and is centered with respect to the groove 16. The diameter of the hole 34 is slightly larger than the width of the groove 16 such that opposed portions of the hole 34 extend beyond opposite sides of the groove 16. Thereafter, the final step in formation of the first ring member 12 is accomplished by milling an open slot through the upper surface of the segment 32 coplanar with the groove 16 and of a width generally equal thereto. In any event, the width of the slot 20 is slightly less than the diameter of the hole 35 so as to form the aforesaid detents 22. The length of the slot 20 is also at least 180° and preferably somewhat greater than 180° such that the second ring 14 may be fully inserted through the slot 20 for engagement in the groove 16 in the intended manner with opposed prongs 26 snugly interfitting within the detents 22. The slot is coextensive with the groove through an at least 180 degree portion of the groove.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. The method of forming a composite ring including a first relatively wide and thick circular ring having a circumferentially extending groove disposed in the lower internal surface thereof, a circumferentially extending slot of at least 180° extent disposed through the upper portion thereof and communicating with said groove, and a pair of outwardly extending detents centrally disposed with respect to and communicating with said slot and wherein a second ring of lesser width is adapted for removable engagement therewith, comprising the sequential steps of cutting a hollow tubular member to form a blank for said first ring, grinding the outer surface of said blank so as to provide a domed configuration, cutting a circular groove into the internal surface of said first ring, boring a circular hole of a diameter slightly greater than the width of said groove through the outer surface of said first ring and into said groove generally centrally thereof, and thereafter cutting an open slot coextensive with said groove through an at least 180° portion of said first ring and communicating with said hole, whereby the opposed outer portions of said hole define said pair of opposed detents.

* * * * *